United States Patent [19]

Vinyard et al.

[11] Patent Number: 4,759,562

[45] Date of Patent: Jul. 26, 1988

[54] WALKER CONVERSIONS FOR WHEEL CHAIRS

[76] Inventors: Lillian L. Vinyard, Rte. 7, Box 410, St. Charles, Mo. 63301; Edward J. Taylor, Box 136, Rte. 1, Winfield, Mo. 63389

[21] Appl. No.: 861,446

[22] Filed: May 9, 1986

[51] Int. Cl.[4] ..... A61H 3/04

[52] U.S. Cl. ..... 280/289 WC; 272/70.3; 280/87.02 R; 297/5; 297/DIG. 4

[58] Field of Search ..... 280/289 WC, 242 WC, 280/87.02; 272/70.3, 70.4; 297/5, 6, DIG. 4

[56] References Cited

U.S. PATENT DOCUMENTS

| | | | |
|---|---|---|---|
| 2,556,121 | 6/1951 | Thomas | 280/289 WC |
| 3,708,182 | 1/1973 | Markiel | 280/289 WC |
| 4,431,076 | 2/1984 | Simpson | 280/242 WC |

*Primary Examiner*—John J. Love
*Assistant Examiner*—Donn McGiehan
*Attorney, Agent, or Firm*—Rogers, Howell, Moore & Haferkamp

[57] ABSTRACT

A kit for converting a wheel chair into a walker for a patient comprising a seat for replacing the wheel chair bottom, a base for mounting the seat to the wheel chair to define an open space for the patient in front of the seat between the sides of the wheel chair, the seat positioned immediately below the patient's buttocks when the patient is standing in the space. The kit also includes an inverted U-shaped support bar is mounted across the front of the wheel chair in position where it can be grasped by the patient, the support bar retaining the patient between the sides of the wheel chair and the seat.

19 Claims, 2 Drawing Sheets

WALKER CONVERSIONS FOR WHEEL CHAIRS

BACKGROUND AND SUMMARY OF THE INVENTION

This invention relates to a device for converting a wheel chair into a walker for the disabled.

It is important to the recovery of the sick and injured that they receive exercise. It is also important to the continued health of the disabled that they receive regular exercise. However, walking a sick or injured or disabled person requires the assistance of at least one, and sometimes two or three persons. Because of a shortage of staff and the cost of such personal attention, the walking of patients is often neglected in health care institutions. Because of insurance problems and the possibility of accidents, the institution's regulations usually prohibit family or friends from walking the patient. In the home, there is usually not enough help to safely walk the patient.

Special therapy equipment is available to exercise the sick or injured or disabled, but this equipment is usually too cumbersome and too expensive for home use. Such equipment also requires trained therapists, and thus because of staffing and cost limitations the equipment is not available to all who could benefit from it. What has been lacking was an inexpensive readily available device to allow a sick or injured or disabled person to walk without assistance and without risk of falling or injury.

The inventor has made a walker that is both inexpensive and readily available. The walker is converted from a wheel chair, which are readily available in health care institutions and in many homes. The walker, however, can be quickly converted back into a wheel chair so that the walker conversion does not impair the use of the wheel chair. The walker can be made from a folding wheel chair so that both devices can be easily stored and transported.

The walker comprises an adjustable seat unit having a base that can be engaged to the wheel chair's seat support. The base is quickly releasable from the wheel chair so that conversion between a wheel chair and a walker is fast and simple. A cushioned seat, having a tapered tongue projecting from its front edge for extending between the user's legs, is positioned immediately below the user's buttocks. The height of the seat relative to the base is adjustable to accomodate various users. The seat is constructed and positioned to allow the user to walk unimpaired but to catch the user should the user stumble and fall. The seat could also be positioned to support the user while the user is attempting to walk.

A generally U-shaped support bar is mounted inverted to the front of the wheel chair, the top of the "U" extending across the front of the wheel chair to provide a support for the user. The height of the support is adjustable so that it can be put in a comfortable position for the user to hold while attempting to walk. The support bar is quickly releasable from the wheel chair so that conversion between a wheel chair and walker is fast and simple.

The walker of this invention provides an inexpensive, safe way for the sick or injured or disabled to walk with minimal assistance and supervision. This frees up health care professionals for other duties and allows the sick or injured or disabled to walk in the home environment where professional assistance is not available. A wheel chair can be quickly and easily converted to a walker, and the walker can be quickly returned to use as a wheel chair. Because the walker utilizes a wheel chair without impairing its function as a wheel chair, the device is relatively inexpensive and thus more widely available, especially for home use. The walker can be used to actually support the user while walking or simply as a safety device to catch the user should he or she fall while walking.

DETAILED DESCRIPTION OF THE PREFERRED EMBODIMENT

Figure 1:
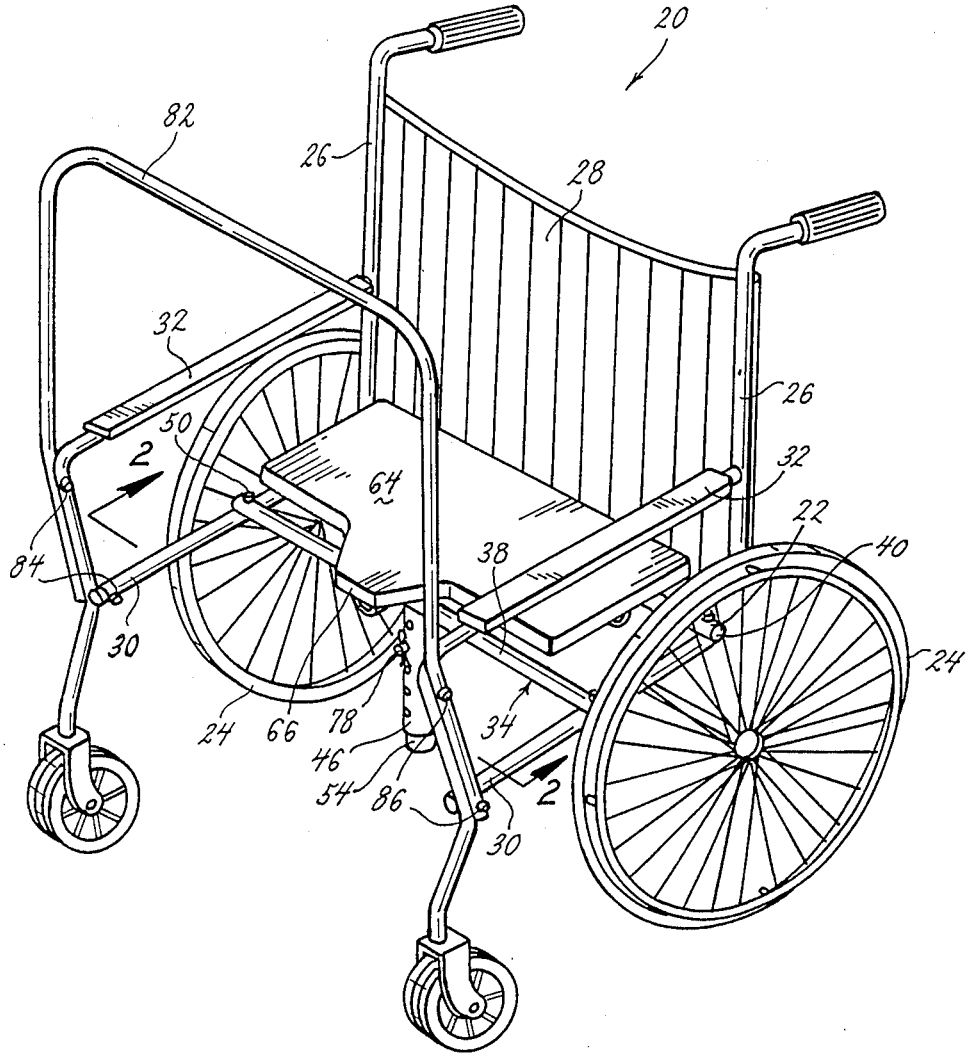
FIG. 1 is an orthogonal view of a wheel chair converted into a walker according to the principles of this invention.

A wheel chair converted into a walker according to the principles of this invention is indicated generally as 20 in FIG. 1. The wheel chair 20 comprises a frame 22 supporting a wheel 24 on each side. The frame 22 comprises two vertical supports 26 on opposite sides of the wheel chair 20. A chair back 28 is mounted between the supports 26. The frame 22 also comprises two forwardly extending horizontal supports 30. A chair bottom can be mounted between supports, but as shown in FIG. 1 the bottom is removed to convert the wheel chair 20 into a walker. An arm rest 32 extends between the vertical support 26 and the horizontal support 30 on each side of the wheel chair 20.

Figure 5:
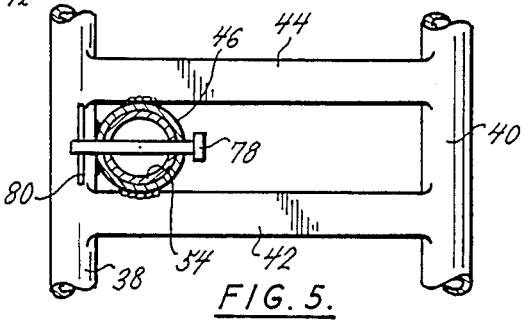

A seat unit 34 is mounted to the wheel chair 20 as part of the conversion. The seat unit 34 comprises a base 36 having a front member 38, a rear member 40, and two cross pieces 42 and 44 extending between the front and rear members 38 and 40. As shown in FIG. 5, hollow cylindrical sheath 46 is mounted between the cross pieces 42 and 44, adjacent to the front member 38 and is secured as by welds. The sheath 46 extends generally downwardly from the base 36. The sheath 46 has a number of diametrically opposed pairs of holes 48 axially spaced along its length.

The base 36 is releasably mounted to the frame 22 of the wheel chair 20. Bolts 50 and nuts 52 releasably secure the ends of the front and rear members 38 and 40 to horizontal supports 30. Of course some other structure for engaging the base 36 to the frame 22 can be used.

Figure 2:
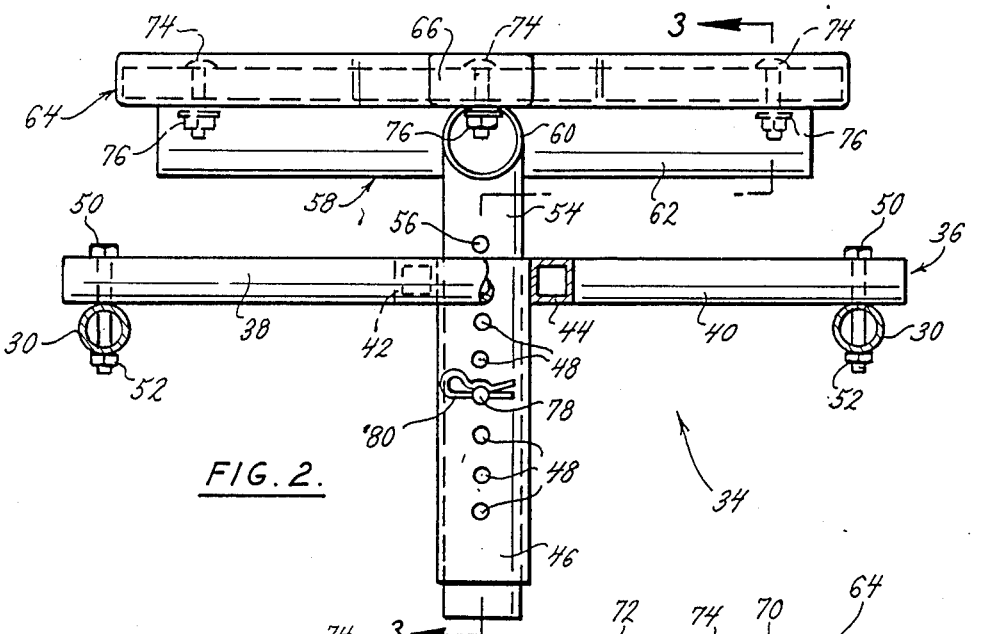
FIG. 2 is a partial cross-sectional view of the wheel chair taken along the plane of line 2—2 in FIG. 1, showing the seat unit.
Figure 3:
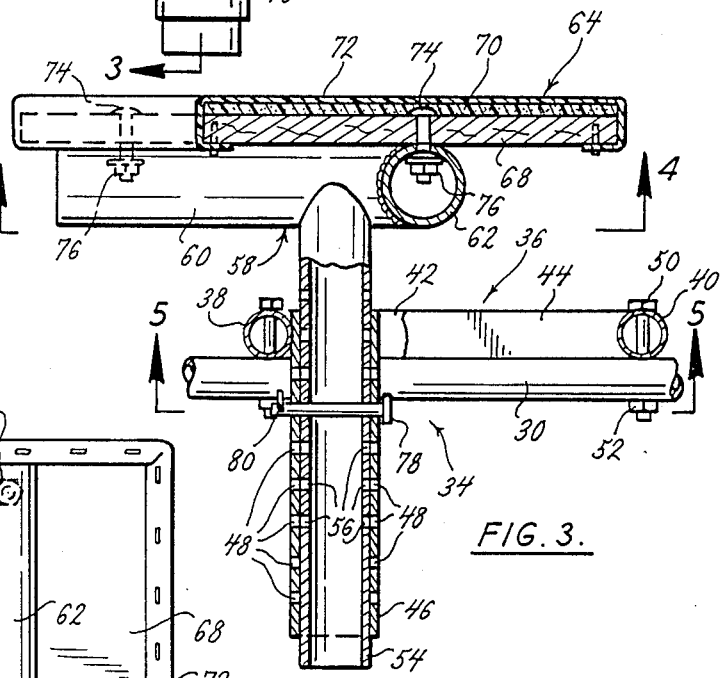
FIG. 3 is a cross-sectional view of the seat unit taken along line 3—3 in FIG. 2.
Figure 4:
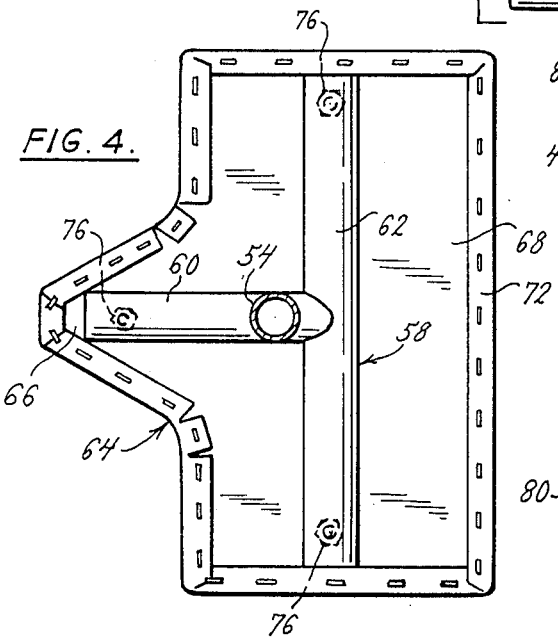
FIG. 4 is a cross-sectional view of the seat unit taken along the plane of line 4—4 in FIG. 3, showing the underside of the seat; and, FIG. 5 is a cross-sectional view of the seat unit taken along the plane of line 5—5 in FIG. 3, showing the adjustable locking mechanism.

A cylindrical rod 54 is slideably received in the sheath 46. The rod 54 has a number of diametrically opposed pairs of holes 56 axially spaced along its length. A T-shaped bracket 58 is mounted at the top of cylindrical rod 54. The T-shaped bracket 58 comprises a stem section 60 and a base section 62. As shown in FIGS. 2, 3, and 4, a cushioned seat 64 is mounted over the T-shaped bracket 52. The seat 64 has a tapering tongue 66 projecting from its front edge. The tongue 66 is adapted to fit between the legs of the user. Seat 64 comprises a rigid board 68, a pad 70 over the top surface of the board 68, and a cover 72 over the top and sides of the board 68 secured around the periphery of the underside of the board 68, as with staples. Bolts 74 extend downwardly through board 68, extending from the underside of the board 68. Nuts 76 thread onto bolts 74 and secure seat 64 to T-shaped bracket 58.

Seat 64 is preferably positioned immediately below the buttocks of the user so that it does not contact the user and interfere with walking. However the seat 64 is in position to immediately catch the user should the user fall while attempting to walk. The seat 64 extends only part of the depth of the bottom of the wheel chair 20 so that the user is well within the sides of the wheel chair 20 when it is used as a walker.

As best shown in FIG. 3, the rod 54 is adjustably secured in the sheath 46 with a pin 78, which is inserted into the aligned holes 48 in the sheath 46 and holes 56 in the rod 54. Pin 78 is secured against removal by a cotter pin 80. The rod can be secured by inserting pins 78 in any aligned pairs of holes. Of course, some other method of adjusting and securing seat 64 can be used.

As shown in FIG. 1, support bar 82 is mounted over the front of wheel chair 20 as part of the conversion. The support bar 82 is generally U-shaped and is mounted inverted with the bottom of the "U" in position in front of the user to provide a hand grip. The legs of the "U" are releasably secured to the front of the arm rests 32 on each side of the wheel chair 20. As shown in FIG. 1, support bar 82 can be secured with bolts 84 and nuts 86. Of course, some other releasable mounting means that allows support bar 82 to be quickly engaged and disengaged, can be used. In particular, one of the legs of the U-shaped support bar 82 can be hingedly mounted to allow the support bar 82 to be swung into and out of position across the front of the wheel chair 20. The other leg of the U-shaped support bar 82 can then be releasably secured. The hinged mounting preferably allows the support bar 82 to be quickly removed from the wheel chair 20.

Because seat 64 extends only a portion of the depth of the normal depth of the bottom of wheel chair 20, the user is positioned well within the sides of the wheel chair. The support bar 82 provides a hand grip for the user and prevents the user from falling forward while the seat unit remains ready to catch and support the user should he or she fall. The invention can be used to convert a wheel chair into a walker in a health care institution or at home. It allows the user to walk with minimal assistance.

There are various changes and modifications which may be made to the invention as would be apparent to those skilled in the art. However, these changes or modifications are included in the teaching of the disclosure, and it is intended that the invention be limited only by the scope of the claims appended hereto.

We claim:

1. A walker made from a wheel chair having a frame having two sides, a bottom and a back extending between the sides forming the chair, a wheel mounted on the back of each side, and a wheel mounted on the front of each side, the walker comprising:

a seat having a smaller front to back dimension than the sides of the wheel chair;

means mounting the seat to the wheel chair;

a support bar;

means mounting the support bar across the front of the wheel chair and directly above the front wheels in position where it can be grasped by a patient; and, the front of seat, the sides of the wheelchair, and the support bar defining an open space, the space for allowing the patient to operate the wheel chair as a walker.

2. The walker of claim 1 wherein the seat further comprises a tapering tongue extending from the front, for extending between the patient's legs.

3. The walker of claim 1 wherein the seat is padded.

4. The walker of claim 1 wherein the support bar comprises a generally inverted U-shaped member and wherein the means mounting support bar comprises means for mounting each of the legs of the "U" to one side of the wheel chair.

5. The walker of claim 1 wherein the means mounting the seat comprises a base having a sheath, means for mounting the base to the wheel chair; a rod depending from the seat, the rod slideably received in the sheath, and means for engaging the rod and the sheath.

6. The walker of claim 5 wherein the base further comprises a front member and a rear member and two cross members extending between the front and rear members, and wherein the sheath is mounted between the cross members adjacent the front member.

7. The walker of claim 6 wherein the means for engaging the rod and the sheath comprise a plurality of holes in at least one of the sheath or the rod and at least one hole in the other of the sheath or the rod, and a pin for insertion through aligned holes in the sheath and rod.

8. A kit for converting a wheel chair into a walker for a patient, the wheel chair comprising a frame having two sides, a bottom and a back extending between the sides forming the chair, a wheel mounted on the back of each side, and a wheel mounted on the front of each side, the kit comprising:

a seat for replacing the wheel chair bottom, the seat having a smaller front to back dimension than the sides of the wheel chair;

means for mounting the seat to the wheel chair;

a support bar;

means for mounting the support bar across the front of the wheel chair and directly above the front wheels in position where it can be grasped by a patient; and, the front of the seat, the sides of the wheel chair, and the support bar defining an open space, the space for allowing the patient to operate the wheel chair as a walker.

9. The kit of claim 8, wherein the seat further comprises a tapering tongue extending from the front, for extending between the patient's legs.

10. The kit of claim 8 wherein the seat is padded.

11. The kit of claim 8 wherein the support bar comprises a generally inverted U-shaped member and wherein the means mounting support bar comprises means for mounting each of the legs of the "U" to one side of the wheel chair.

12. The kit of claim 8 wherein the means mounting the seat comprises a base having a sheath, means for mounting the base to the wheel chair; a rod depending from the seat, the rod slideably received in the sheath, and means for engaging the rod and the sheath.

13. The kit of claim 12 wherein the base further comprises a front member and a rear member and two cross members extending between the front and rear members, and wherein the sheath is mounted between the cross members adjacent the front member.

14. The kit of claim 13 wherein the means for engaging the rod and the sheath comprise a plurality of holes in at least one of the sheath or the rod and at least one hole in the other of the sheath or the rod, and a pin for insertion through aligned holes in the sheath and rod.

15. A kit for converting a wheel chair into a walker for a patient, the wheel chair comprising a frame having two sides, a bottom and back extending between the sides forming the chair, a wheel mounted on the back of each side, and a wheel mounted on the front of each side, the kit comprising a seat unit for replacing the wheel chair bottom, the seat unit comprising a base having a sheath, means for mounting the base to the wheel chair; a rod received in the sheath; a seat mounted on the rod, the seat having a smaller front to back dimension than the sides of the wheel chair, the seat further having a tapering tongue extending from the front;

means for adjustably engaging the rod and the sheath to engage the seat in a position immediately below the patient's buttocks with the tongue extending between the patient's legs;

a support bar;

means for mounting the support bar substantially across the front of the wheel chair and directly above the front wheels in position where it can be grasped by the patient; and, the front of the seat, the sides of the wheel chair, and the support bar defining an open space, the space for allowing the patient to operate the wheel chair as a walker.

16. The kit of claim 15 wherein the seat is padded.

17. The kit of claim 15 wherein the support bar comprises a generally inverted U-shaped member and wherein the means mounting support bar comprises means for mounting each of the legs of the "U" to one side of the wheel chair.

18. The kit of claim 15 wherein the base further comprises a front member and a rear member extending between the sides of the wheel chair and two cross members extending between the front and rear members, and wherein the sheath is mounted between the cross members adjacent the front member.

19. The kit of claim 15 wherein the means for engaging the rod and the sheath comprise a plurality of holes in at least one of the sheath or the rod and at least one hole in the other of the sheath or the rod, and a pin for insertion through aligned holes in the sheath and rod.

* * * * *